US009940898B2

(12) United States Patent
Cook et al.

(10) Patent No.: US 9,940,898 B2
(45) Date of Patent: Apr. 10, 2018

(54) VARIABLE REFRESH RATE VIDEO CAPTURE AND PLAYBACK

(71) Applicant: NVIDIA Corporation, Santa Clara, CA (US)

(72) Inventors: David Cook, San Jose, CA (US); Lu Liu, San Jose, CA (US)

(73) Assignee: NVIDIA CORPORATION, Santa Clara, CA (US)

( * ) Notice: Subject to any disclaimer, the term of this patent is extended or adjusted under 35 U.S.C. 154(b) by 0 days.

(21) Appl. No.: 15/054,019

(22) Filed: Feb. 25, 2016

(65) Prior Publication Data

US 2017/0249920 A1 Aug. 31, 2017

(51) Int. Cl.
*G09G 5/00* (2006.01)
*G09G 5/36* (2006.01)

(52) U.S. Cl.
CPC ..... *G09G 5/006* (2013.01); *G09G 5/363* (2013.01); *G09G 2340/02* (2013.01); *G09G 2360/06* (2013.01); *G09G 2360/08* (2013.01); *G09G 2360/10* (2013.01); *G09G 2360/18* (2013.01); *G09G 2370/022* (2013.01); *G09G 2370/16* (2013.01)

(58) Field of Classification Search
None
See application file for complete search history.

(56) References Cited

U.S. PATENT DOCUMENTS

| | | | | |
|---|---|---|---|---|
| 5,801,780 | A | 9/1998 | Schaumont et al. | |
| 6,141,461 | A | 10/2000 | Carlini | |
| 6,249,549 | B1 | 6/2001 | Kim | |
| 6,631,240 | B1 * | 10/2003 | Salesin | G06T 9/40 348/E7.071 |
| 6,804,418 | B1 | 10/2004 | Yu et al. | |
| 8,139,081 | B1 | 3/2012 | Daniel | |
| 8,218,860 | B1 | 7/2012 | Berger et al. | |
| 2002/0101432 | A1 | 8/2002 | Ohara et al. | |
| 2004/0052432 | A1 | 3/2004 | Lee et al. | |
| 2004/0119887 | A1 | 6/2004 | Franzen | |
| 2004/0263495 | A1 | 12/2004 | Sugino et al. | |
| 2005/0162566 | A1 | 7/2005 | Chuang et al. | |
| 2005/0212740 | A1 | 9/2005 | Miyagawa | |
| 2007/0109256 | A1 | 5/2007 | Fry | |
| 2007/0120793 | A1 | 5/2007 | Kimura | |
| 2008/0309656 | A1 | 12/2008 | Van Woudenberg et al. | |
| 2009/0027545 | A1 | 1/2009 | Yeo et al. | |
| 2009/0179923 | A1 | 7/2009 | Amundson et al. | |
| 2009/0219244 | A1 | 9/2009 | Fletcher et al. | |
| 2009/0257621 | A1 | 10/2009 | Silver | |
| 2009/0313484 | A1 | 12/2009 | Millet et al. | |
| 2010/0253611 | A1 | 10/2010 | Takagi et al. | |
| 2010/0302269 | A1 | 12/2010 | Morimoto | |

(Continued)

*Primary Examiner* — Kumar Patel
*Assistant Examiner* — Richard M Russell

(57) ABSTRACT

A method for displaying video. The method includes executing an application at a processor. As instructed by the processor when executing the application, the method includes rendering a plurality of image frames at a plurality of graphics processing units (GPUs). The method includes determining information related to relative timing between renderings of the plurality of image frames. The method includes encoding the plurality of image frames into a video file. The method includes encoding the information into the video file.

20 Claims, 8 Drawing Sheets

(56) References Cited

U.S. PATENT DOCUMENTS

| | | | | |
|---|---|---|---|---|
| 2011/0261094 | A1 | 10/2011 | Ruckmongathan | |
| 2011/0273482 | A1 | 11/2011 | Massart et al. | |
| 2011/0285683 | A1 | 11/2011 | Todorovich et al. | |
| 2011/0292246 | A1 | 12/2011 | Brunner | |
| 2012/0176396 | A1 | 7/2012 | Harper et al. | |
| 2012/0201476 | A1 | 8/2012 | Carmel et al. | |
| 2013/0015770 | A1 | 1/2013 | Aitken | |
| 2013/0063469 | A1 | 3/2013 | Ruckmongathan | |
| 2013/0107120 | A1 | 5/2013 | Inoue et al. | |
| 2013/0249880 | A1 | 9/2013 | Chen et al. | |
| 2014/0139706 | A1 | 5/2014 | Jang et al. | |
| 2014/0168185 | A1 | 6/2014 | Han et al. | |
| 2014/0307962 | A1 | 10/2014 | Seikh | |
| 2014/0325367 | A1* | 10/2014 | Fear | G06F 3/048 715/738 |
| 2014/0333516 | A1 | 11/2014 | Park et al. | |
| 2014/0368484 | A1 | 12/2014 | Tanaka et al. | |
| 2015/0194111 | A1 | 7/2015 | Slavenburg et al. | |
| 2015/0243233 | A1 | 8/2015 | Bloks et al. | |
| 2015/0243234 | A1 | 8/2015 | Bloks et al. | |
| 2015/0348509 | A1* | 12/2015 | Verbeure | H04N 9/3188 345/213 |
| 2016/0196801 | A1* | 7/2016 | Glen | G09G 5/18 345/213 |

* cited by examiner

700

800

VARIABLE REFRESH RATE VIDEO CAPTURE AND PLAYBACK

BACKGROUND

Conventionally, image frames are rendered to allow display thereof by a display device. For example, a 3-dimensional (3D) virtual world of a video game may be rendered by a graphics processing unit (GPU) to show image frames having a corresponding 2-dimensional (2D) perspective. In any case, the time to render each image frame (i.e., the rendering rate of each frame) is variable depending on the computational complexity. For example, the rendering rate may depend on the number of objects in the scene shown by the image frame, the number of light sources, the camera viewpoint/direction, etc.

Unfortunately, the refresh rate of the a display device has generally been independent of the rendering rate. For example, currently video is designed to playback at fixed rates of 24 Hz, 60 Hz, etc. That is, video is displayed at a fixed rate no matter the rendering rate, which is variable. This has resulted in limited schemes being introduced that attempt to compensate for any discrepancies between the differing rendering and display refresh rates.

By way of example, a vertical synchronization-on (vsync-on) mode and a vertical synchronization-off (vsync-off) mode are techniques that have been introduced to compensate for any discrepancies between the differing rendering and display refresh rates. In practice, these modes have been used exclusively for a particular application, as well as in combination where the particular mode selected can be dynamically based on whether the GPU render rate is above or below the refresh rate of the display device.

However, vsync-on and vsync-off have exhibited various limitations. For instance, when a display device is operating in a vsync-on mode, an already rendered image frame will have to wait until the end of a refresh cycle before that image frame is thrown up for display. More particularly, when the GPU render rate of an image frame is slower than the display device refresh rate (e.g., 60 Hz), then the effective refresh rate is halved, because an image may be shown twice over two refresh cycles. Also, when the GPU render rate is faster than the display device refresh rate, then there is still latency introduced, as the finished image frame must still wait till the end of the refresh cycle before being shown. As such, rendered video is not immediately put up for display when operating in vsync-on mode.

In the other case, when a display device is operating in vsync-off mode, the GPU starts sending the pixels of an image frame to the display device as soon as the rendering is complete. In addition, the GPU abandons sending pixels from an earlier image frame. In this case, the GPU need not wait before rendering the next image frame, as the buffer is immediately flushed. As a result, in vsync-off mode, there is less latency, and faster rendering. However, because the GPU immediately begins to send pixel information for an image frame that has completed rendering, the display device may show a "tear line" where the newly rendered frame is written to the display in the middle of a refresh cycle. That is, pixels from a previous image frame are shown on one side of the tear line, while pixels from the new image frame are shown on the other side of the tear line. The tear line is especially noticeable when an object in the rendered scene over multiple image frames are moving. As result, part of the object is below the tear line, and part of the object is above the tear line. Both parts are displaced from each other, and the object appear torn.

There is a need for addressing these and/or other issues in the prior art.

SUMMARY

In embodiments of the present invention, a computer implemented method for displaying video is disclosed. In other embodiments, a non-transitory computer readable medium is disclosed having computer-executable instructions for causing a computer system to perform a method for displaying video. In still other embodiments, a computer system is disclosed comprising a processor and memory coupled to the processor and having stored therein instructions that, if executed by the computer system, cause the computer system to execute a method for displaying video. The method includes executing an application at a processor. As instructed by the processor when executing the application, the method includes rendering a plurality of image frames at a plurality of graphics processing units (GPUs). The method includes determining information related to relative timing between renderings of the plurality of image frames. The method includes encoding the plurality of image frames into a video file. The method includes encoding the information into said video file These and other objects and advantages of the various embodiments of the present disclosure will be recognized by those of ordinary skill in the art after reading the following detailed description of the embodiments that are illustrated in the various drawing figures.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

DETAILED DESCRIPTION OF THE INVENTION

Figure 1:
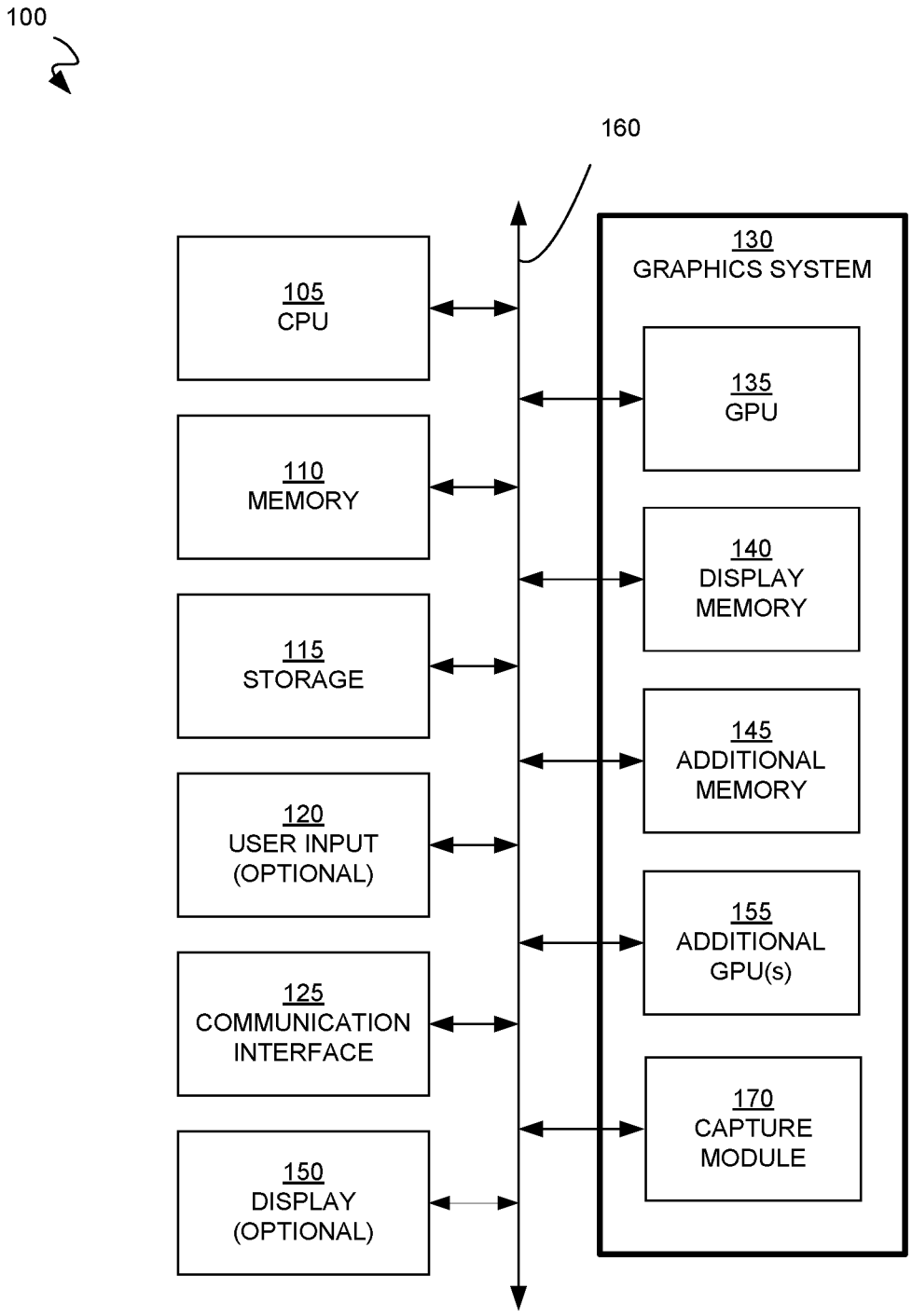
FIG. 1 depicts a block diagram of an exemplary computer system suitable for implementing embodiments according to the present disclosure.

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Accordingly, embodiments of the present invention are able to capture rendered image frames from an application along with information related to the timing of the rendering. The captured image frames with rendering timing information can be played back on a vertical refresh rate (VRR) display that is configured to display images using a display device having a dynamic and variable refresh rate that is matched more or less to the render rate of the image frames. In that manner, the image frames are displayed the same as it would be if rendered in real-time, with little or no latency involved.

Some portions of the detailed descriptions that follow are presented in terms of procedures, logic blocks, processing, and other symbolic representations of operations on data bits within a computer memory. These descriptions and representations are the means used by those skilled in the data processing arts to most effectively convey the substance of their work to others skilled in the art. In the present application, a procedure, logic block, process, or the like, is conceived to be a self-consistent sequence of steps or instructions leading to a desired result. The steps are those utilizing physical manipulations of physical quantities. Usually, although not necessarily, these quantities take the form of electrical or magnetic signals capable of being stored, transferred, combined, compared, and otherwise manipulated in a computer system. It has proven convenient at times, principally for reasons of common usage, to refer to these signals as transactions, bits, values, elements, symbols, characters, samples, pixels, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present disclosure, discussions utilizing computing terms such as "executing," "rendering," "determining," "executing," "encoding," "sending," or the like, refer to actions and processes of a computer system or similar electronic computing device or processor (e.g., in flow charts 7 and 8 of the present Application). The computer system or similar electronic computing device manipulates and transforms data represented as physical (electronic) quantities within the computer system memories, registers or other such information storage, transmission or display devices.

Figure 7:
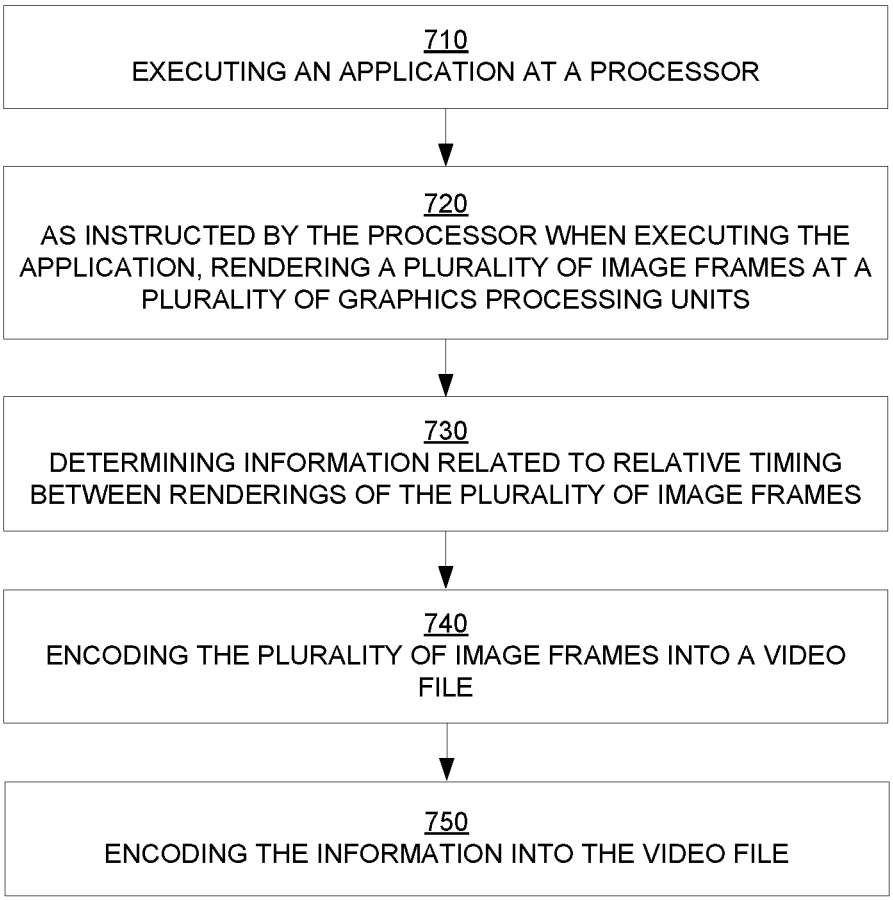
FIG. 7 is a flow diagram illustrating a method for capturing render timing information related to relative timing between rendering of a plurality of rendered image frames, in accordance with one embodiment of the present disclosure.
Figure 8:
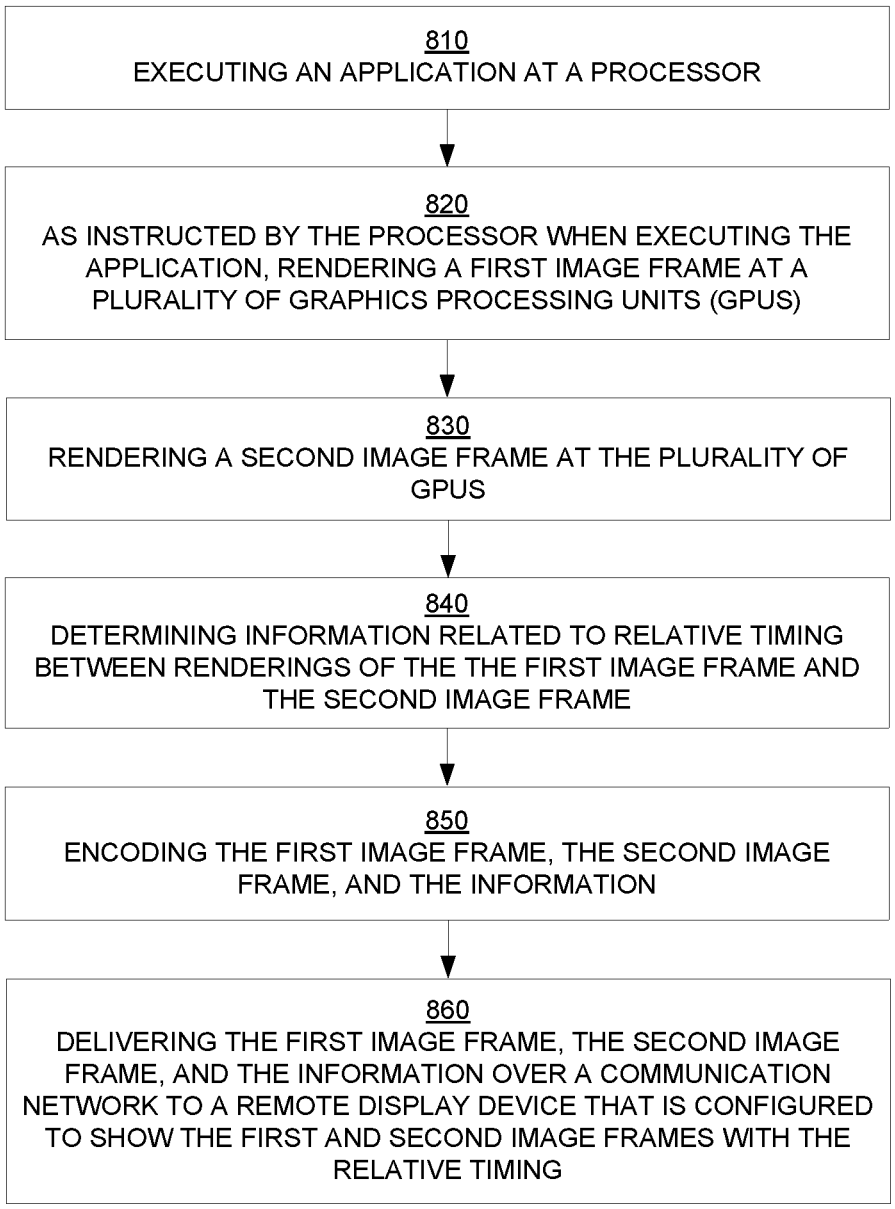
FIG. 8 is a flow diagram illustrating a method for displaying image frames captured in a video file using render timing information such that the image frames are displayed as if rendered from a GPU in real-time, in accordance with one embodiment of the present disclosure.

FIGS. 7 and 8 are flowcharts of examples of computer-implemented methods for capturing rendered image frames from an executed application along with information related to the timing of the rendering such that the image frames may be displayed on a display device at the same refresh rate as if the image frames were rendered in real-time, according to embodiments of the present invention. Although specific steps are disclosed in the flowcharts, such steps are exemplary. That is, embodiments of the present invention are well-suited to performing various other steps or variations of the steps recited in the flowcharts.

Other embodiments described herein may be discussed in the general context of computer-executable instructions residing on some form of computer-readable storage medium, such as program modules, executed by one or more computers or other devices. By way of example, and not limitation, computer-readable storage media may comprise non-transitory computer storage media and communication media. Generally, program modules include routines, programs, objects, components, data structures, etc., that perform particular tasks or implement particular abstract data types. The functionality of the program modules may be combined or distributed as desired in various embodiments.

Computer storage media includes volatile and nonvolatile, removable and non-removable media implemented in any method or technology for storage of information such as computer-readable instructions, data structures, program modules or other data. Computer storage media includes, but is not limited to, random access memory (RAM), read only memory (ROM), electrically erasable programmable ROM (EEPROM), flash memory or other memory technology, compact disk ROM (CD-ROM), digital versatile disks (DVDs) or other optical storage, magnetic cassettes, magnetic tape, magnetic disk storage or other magnetic storage devices, or any other medium that can be used to store the desired information and that can accessed to retrieve that information.

Communication media can embody computer-executable instructions, data structures, and program modules, and includes any information delivery media. By way of example, and not limitation, communication media includes wired media such as a wired network or direct-wired connection, and wireless media such as acoustic, radio frequency (RF), infrared and other wireless media. Combinations of any of the above can also be included within the scope of computer-readable media.

FIG. 1 is a block diagram of an example of a computing system 100 capable of implementing embodiments of the present disclosure. Computing system 100 broadly represents any single or multi-processor computing device or system capable of executing computer-readable instructions. Examples of computing system 100 include, without limitation, workstations, laptops, client-side terminals, servers, distributed computing systems, handheld devices, or any other computing system or device. In its most basic configuration, computing system 100 may include at least one processor 105 and a system memory 110.

It is appreciated that computer system 100 described herein illustrates an exemplary configuration of an operational platform upon which embodiments may be implemented to advantage. Nevertheless, other computer system with differing configurations can also be used in place of computer system 100 within the scope of the present invention. That is, computer system 100 can include elements other than those described in conjunction with FIG. 1. Moreover, embodiments may be practiced on any system which can be configured to enable it, not just computer systems like computer system 100. It is understood that embodiments can be practiced on many different types of computer systems 100. System 100 can be implemented as, for example, a desktop computer system or server computer system having a power general-purpose CPUs coupled to a dedicated graphics rendering GPU. In such an embodiment, components can be included that add peripheral buses, specialized audio/video components, I/O devices, and the like. Similarly system 100 can be implemented as a hand-held device (e.g., cell phone, etc.) or a set-top video game console device, such as, for example Xbox®, available from Microsoft corporation of Redmond, Wash., or the PlayStation3®, available from Sony Computer Entertainment Corporation of Tokyo, Japan. System 100 can also be implemented as a "system on a chip", where the electronics (e.g., the components 105, 110, 115, 120, 125, 130, 150, and the like) of a computing device are wholly contained within a single integrated circuit die. Examples include a hand-held instrument with a display, a car navigation system, a portable entertainment system, and the like.

In the example of FIG. 1, the computer system 100 includes a central processing unit (CPU) 105 for running software applications and optionally an operating system. Memory 110 stores applications and data for use by the CPU 105. Storage 115 provides non-volatile storage for applications and data and may include fixed disk drives, removable disk drives, flash memory devices, and CD-ROM, DVD-ROM or other optical storage devices. The optional user input 120 includes devices that communicate user inputs from one or more users to the computer system 100 and may include keyboards, mice, joysticks, touch screens, and/or microphones.

The communication or network interface 125 allows the computer system 100 to communicate with other computer systems via an electronic communications network, including wired and/or wireless communication and including the Internet. The optional display device 150 may be any device capable of displaying visual information in response to a signal from the computer system 100. The components of the computer system 100, including the CPU 105, memory 110, data storage 115, user input devices 120, communication interface 125, and the display device 150, may be coupled via one or more data buses 160.

In the embodiment of FIG. 1, a graphics system 130 may be coupled with the data bus 160 and the components of the computer system 100. The graphics system 130 may include a physical graphics processing unit (GPU) 135 and graphics memory. The GPU 135 generates pixel data for output images from rendering commands. The physical GPU 135 can be configured as multiple virtual GPUs that may be used in parallel (concurrently) by a number of applications executing in parallel.

Graphics memory may include a display memory 140 (e.g., a frame buffer) used for storing pixel data for each pixel of an output image. In another embodiment, the display memory 140 and/or additional memory 145 may be part of the memory 110 and may be shared with the CPU 105. Alternatively, the display memory 140 and/or additional memory 145 can be one or more separate memories provided for the exclusive use of the graphics system 130.

In another embodiment, graphics processing system 130 includes one or more additional physical GPUs 155, similar to the GPU 135. Each additional GPU 155 may be adapted to operate in parallel with the GPU 135. Each additional GPU 155 generates pixel data for output images from rendering commands. Each additional physical GPU 155 can be configured as multiple virtual GPUs that may be used in parallel (concurrently) by a number of applications executing in parallel. Each additional GPU 155 can operate in conjunction with the GPU 135 to simultaneously generate pixel data for different portions of an output image, or to simultaneously generate pixel data for different output images.

Each additional GPU 155 can be located on the same circuit board as the GPU 135, sharing a connection with the GPU 135 to the data bus 160, or each additional GPU 155 can be located on another circuit board separately coupled with the data bus 160. Each additional GPU 155 can also be integrated into the same module or chip package as the GPU 135. Each additional GPU 155 can have additional memory, similar to the display memory 140 and additional memory 145, or can share the memories 140 and 145 with the GPU 135.

In another embodiment, graphics processing system 130 includes a capture module 170, which is configured to capture image frames that are rendered by GPUs 135 and/or 155. In particular, capture module 170 captures a rendered image frame, and encodes it for storing. For example, the captured frame may be encoded using a H.264 or motion pictures experts group (e.g., MPEG-4, etc.) standard, or one of their derivatives.

Figure 2:
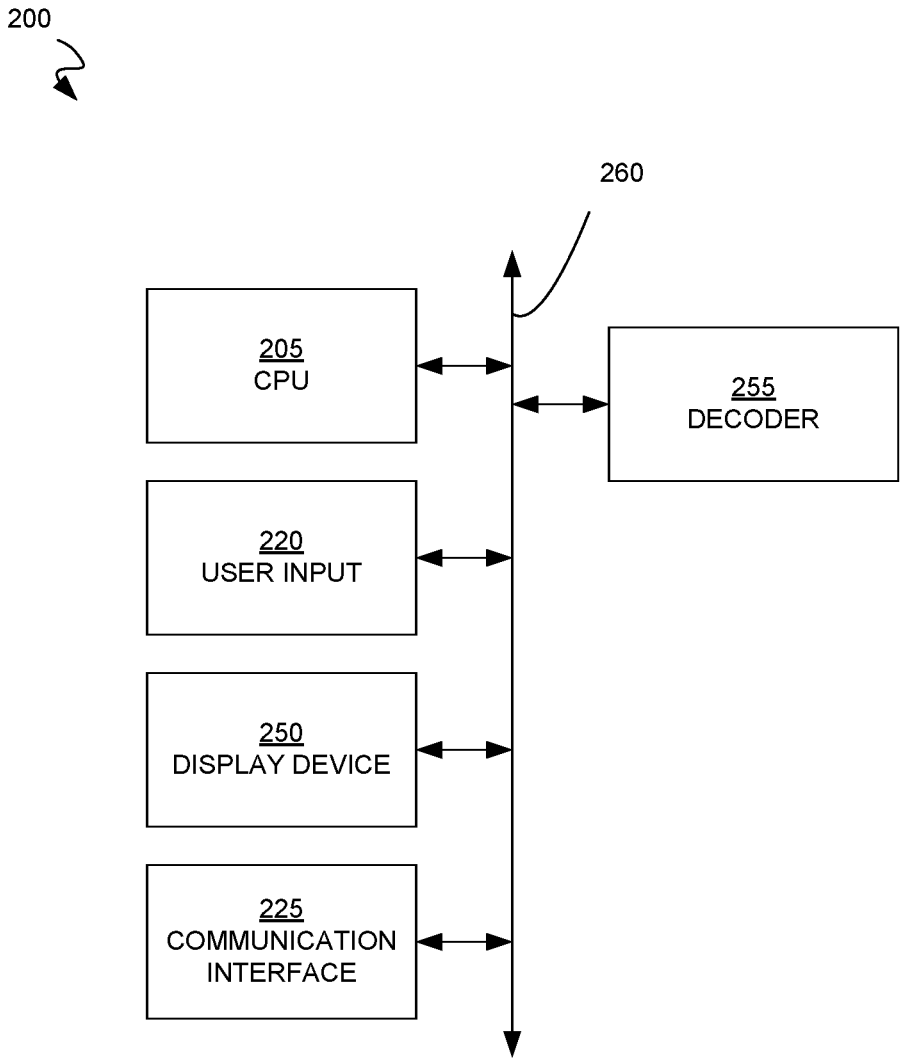
FIG. 2 is a block diagram of an example of a client device capable of implementing embodiments according to the present invention.

FIG. 2 is a block diagram of an example of an end user or client device 200 capable of implementing embodiments according to the present invention. In the example of FIG. 2, the client device 200 includes a CPU 205 for running software applications and optionally an operating system. The user input 220 includes devices that communicate user inputs from one or more users and may include keyboards, mice, joysticks, touch screens, and/or microphones.

The communication interface 225 allows the client device 200 to communicate with other computer systems (e.g., the computer system 100 of FIG. 1) via an electronic communications network, including wired and/or wireless communication and including the Internet. The decoder 255 may be any device capable of decoding (decompressing) data that may be encoded (compressed). For example, the decoder 255 may be an H.264 or MPEG decoder. The display device 250 may be any device capable of displaying visual information, including information received from the decoder 255. The display device 250 may be used to display visual information generated at least in part by the client device 200. However, the display device 250 may be used to display visual information received from the computer system 100. The components of the client device 200 may be coupled via one or more data buses 260. Further, the components may or may not be physically included inside the housing of the client device 200. For example, the display device 250 may be a monitor that the client device 200 communicates with either through cable or wirelessly.

Relative to the computer system 100, the client device 200 in the example of FIG. 2 may have fewer components and less functionality and, as such, may be referred to as a thin client. In general, the client device 200 may be any type of device that has display capability, the capability to decode (decompress) data, and the capability to receive inputs from a user and send such inputs to the computer system 100. However, the client device 200 may have additional capabilities beyond those just mentioned. The client device 200 may be, for example, a personal computer, a tablet computer, a television, a hand-held gaming system, or the like.

In one embodiment, display device 250 is capable of a refresh rate that is variable and dynamically adjusted to match the render rate of the GPU that is rendering image frames of an executing application. For example, display device 250 may incorporate G-SYNC™ technology, which is capable of synchronizing the refresh rate of the display device to the GPU's render rate, which is variable depending on the data being rendered. In particular, display device 250 waits to refresh itself until an image frame is completely rendered, or when the GPU is ready with a new image frame. In one embodiment, display device 250 is able to dynamically change its refresh rate through back channel communications with a corresponding GPU. That is, information regarding the refresh rate is delivered to the display device 250 from the GPU. The refresh rate, in one embodiment, is changed by manipulating the vertical balking interval (VBLANK), which is the period of time between the last line of the current frame being shown, and the first line of the next frame being drawn. That is, the VBLANK interval is modified to cause the display device 250 to hold the presently displayed image frame unit the GPU is ready to deliver the next image frame. Through back-channel communications, the GPU is able to time the delivery of the next image frame while the display device 250 is in a VBLANK interval.

Figure 3:
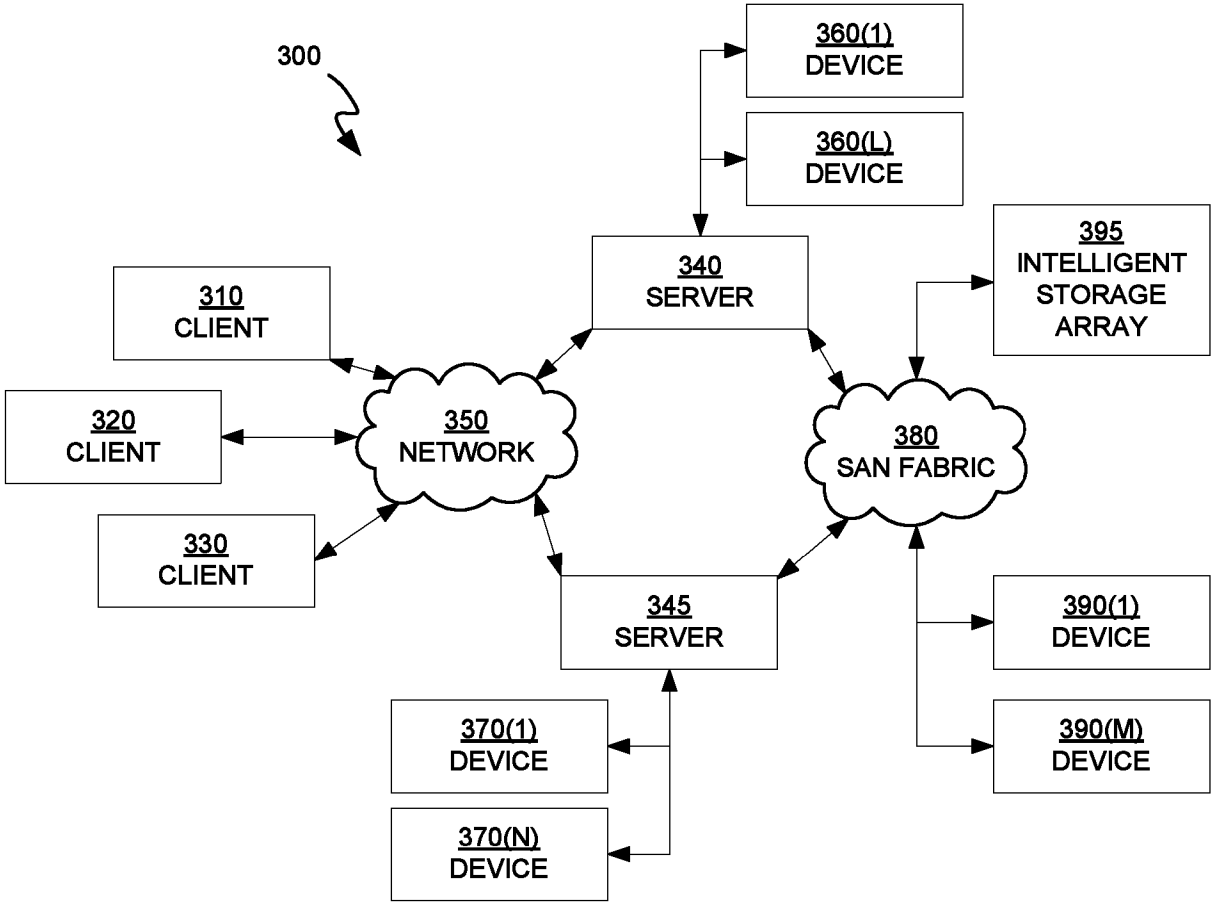
FIG. 3 is a block diagram of an example of a network architecture in which client systems and servers may be coupled to a network, according to embodiments of the present invention.

FIG. 3 is a block diagram of an example of a network architecture 300 in which client systems 310, 320, and 330 and servers 340 and 345 may be coupled to a network 350. Client systems 310, 320, and 330 generally represent any type or form of computing device or system, such as computing system 110 of FIG. 1 and/or client device 200 of FIG. 2.

Similarly, servers 340 and 345 generally represent computing devices or systems, such as application servers, GPU servers, or database servers, configured to provide various database services and/or run certain software applications. Network 350 generally represents any telecommunication or computer network including, for example, an intranet, a wide area network (WAN), a local area network (LAN), a personal area network (PAN), or the Internet.

With reference to computing system 100 of FIG. 1, a communication interface, such as communication interface 125, may be used to provide connectivity between each client system 310, 320, and 330 and network 350. Client systems 310, 320, and 330 may be able to access information on server 340 or 345 using, for example, a web browser or other client software. In that manner, client systems 310, 320, and 330 are configurable to access servers 340 and/or 345 that provide for graphics processing capabilities, thereby off-loading graphics processing to the back end servers 340 and/or 345 for purposes of display at the front end client systems 310, 320, and 330. Further, such software may allow client systems 310, 320, and 330 to access data hosted by server 340, server 345, storage devices 360(1)-(L), storage devices 370(1)-(N), storage devices 390(1)-(M), or intelligent storage array 395. Although FIG. 3 depicts the use of a network (such as the Internet) for exchanging data, the embodiments described herein are not limited to the internet or any particular network-based environment.

In one embodiment, all or a portion of one or more of the example embodiments disclosed herein are encoded as a computer program and loaded onto and executed by server 340, server 345, storage devices 360(1)-(L), storage devices 370(1)-(N), storage devices 390(1)-(M), intelligent storage array 395, or any combination thereof. All or a portion of one or more of the example embodiments disclosed herein may also be encoded as a computer program, stored in server 340, run by server 345, and distributed to client systems 310, 320, and 330 over network 350.

Figure 4:
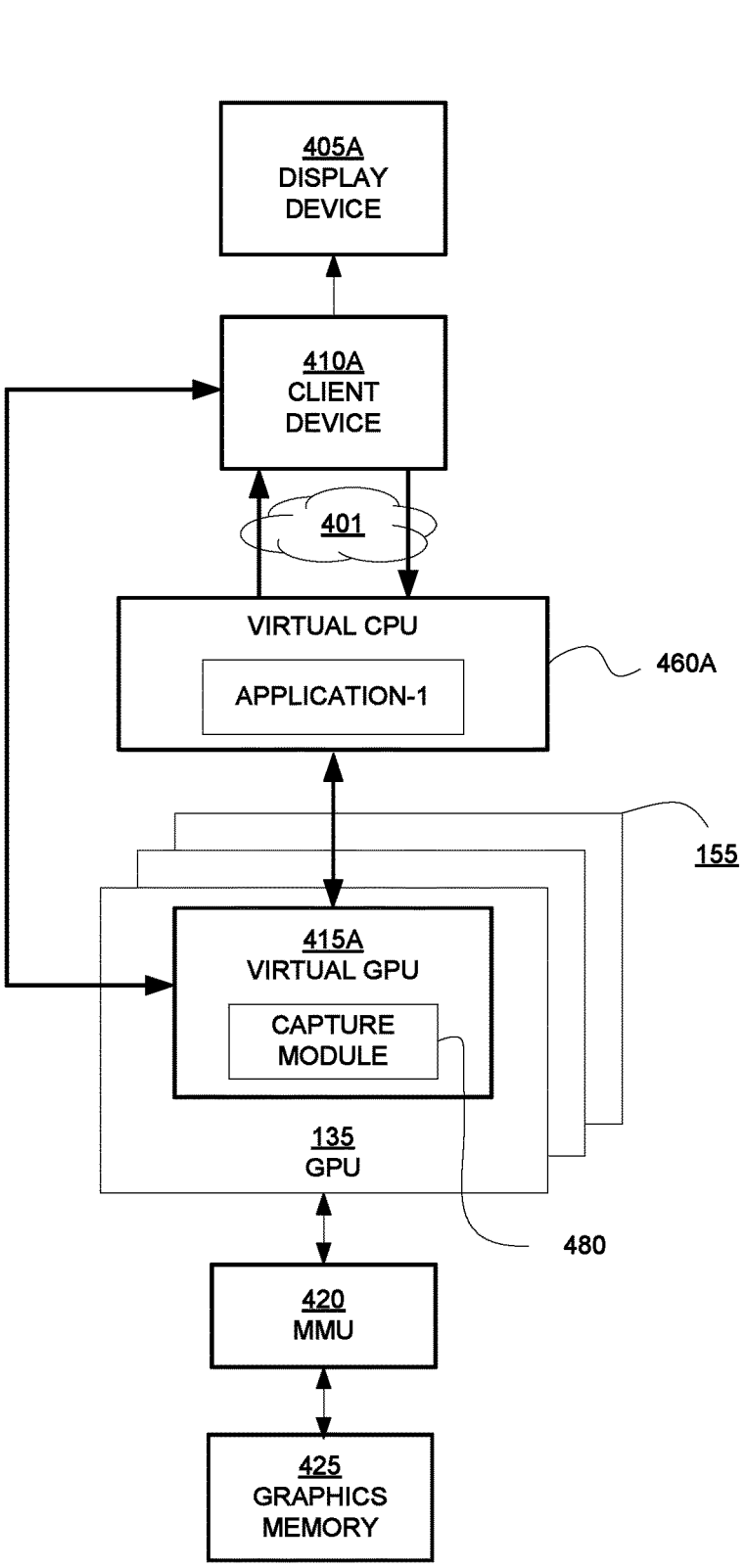
FIG. 4 illustrates a graphics system configurable for implementing cloud based virtualized graphics processing for remote displays, in accordance with one embodiment of the present disclosure.

FIG. 4 illustrates a graphics system 400 configurable for implementing cloud based virtualized graphics processing for remote displays, in accordance with one embodiment of the present disclosure. As shown, the graphics processing system 400 includes a physical GPU 135 of FIG. 1, although system 400 can include additional physical GPUs 155 as described above.

According to embodiments of the present invention, the physical GPU 135 is configured for concurrent use by a number N of applications 1, 2, . . . , N (although only one application—1 is shown for convenience) as executed by one or more virtual CPUs 460A-N (although only one CPU 460A is shown for convenience). More specifically, the physical GPU 135 is configured as a number M of virtual GPUs 415A-N (though only one virtual GPU 415A is shown, for convenience) that are concurrently used by the applications 1, 2, . . . , N. Each of the additional GPUs 155 may be similarly configured as multiple virtual GPUs. In one embodiment, the GPU 135 and the additional GPUs 155 are coupled to a memory management unit 420 (MMU; e.g., an input/output MMU) that is in turn coupled to graphics memory, described in conjunction with FIG. 1.

A back channel 470 is shown that allows for communication between the client device 410A and the virtual GPU 415A. For instance, communication may indicate when the display device 405A is within a VBLANK interval, thereby allowing the GPU 415A to send the next frame for display. In another instance, the communication may indicate the render rate of a particular image frame, and as such, the display device 405A is able to dynamically adjust its refresh rate to match the GPU render rate for that image frame. In one embodiment, the display of the image frames occurs in real-time, as the image frames are being rendered by GPU 415A. In another embodiment, the image frames are stored in a video file, such as by the capture module 480. As will be described below, render timing information is also encoded into the video file, such that display device 405A is able to display the image frames in the video file as if the image frames are being rendered in real-time by using the render timing information.

The applications 1, 2, . . . , N can be video game applications; however, the invention is not so limited. That is, the applications 1, 2, . . . , N can be any type of application. For example, the application may provide financial services, computer aided design (CAD) services, etc. In still another example, the application may be a programming guide that provides, in table form, a list of the various programs that are available on different television channels in different time slots, and the client device may be a set top box (cable or satellite).

Figure 5:
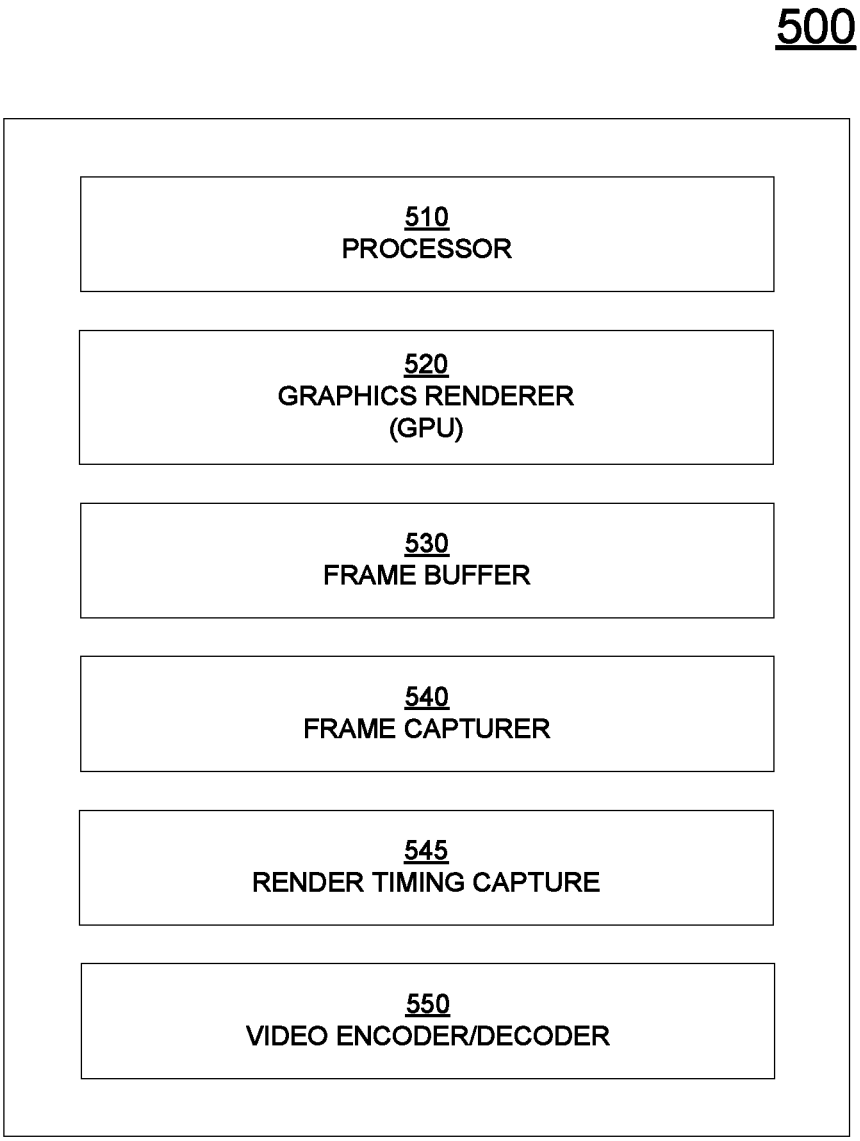
FIG. 5 is a block diagram of a computing system configured for generating image frames from an application, rendering the image frames, and capturing and/or encoding the image frames along with render timing information into a video file, in accordance with one embodiment of the present disclosure.

FIG. 5 is a block diagram of a computing system 500 configured for capturing timing information related to relative time between the renderings of a plurality of image frames, such that a suitable configured display is able to display the image frames as if they are rendered by a GPU in real-time by using the captured timing information, in accordance with one embodiment of the present disclosure. In particular, computing system 500 is configured to generate image frames sequentially from an application, render the image frames sequentially, and capture and/or encode the image frames along with render timing information into a video file for streaming to a display or for storage for later play or replay, in accordance with one embodiment of the present disclosure. Computing system 500 may be implemented within system 100 of FIG. 1, in embodiments of the present invention.

As shown in FIG. 5, system 500 includes a processor 510 is configured to execute an application. In one embodiment, the processor 510 is a virtual machine that is supported by cloud based graphics processing system that provides, in part, virtualized graphics rendering and processing for remote displays.

The processor 510 works in conjunction with the graphics renderer 520 (e.g., GPU) to accelerate certain actions performed by the application. For example, renderer 520 may be used to accelerate compute-intensive portions of the application, as instructed by the processor 510, while the remainder of the application code is executed by the processor 510. For instance, graphics renderer 520 is configured to perform graphics rendering to generate a plurality of frames forming the basis of a video stream. The graphics renderer 520 may comprise thousands of smaller core processing units that are configured to handle multiple tasks (e.g., graphics rendering) simultaneously and in parallel.

Computing system 500 includes a frame buffer 530 for receiving in sequence a plurality of rendered image frames associated with the video stream. In one embodiment, the graphics rendering is performed by the virtual machine in a cloud based graphics rendering system, wherein the video stream of rendered video is then delivered to a remote display. The frame buffer 530 comprises one or more frame buffers configured to receive the rendered image frame. For example, a graphics pipeline may output its rendered video to a corresponding frame buffer. In a parallel system, each pipeline of a multi-pipeline graphics processor will output its rendered video to a corresponding frame buffer.

Computing system 500 includes a frame capture module 540, which is configured to capture image frames that are rendered by graphics renderer 520. In particular, capture module 540 captures a rendered image frame before sending the image frame to a display. In this manner, the captured image frame may be saved. For example, a user may capture a video stream of a gaming application being played by the user using the capture module 540.

Computing system 500 includes a render timing capture module 545, which is configured to capture timing information related to the relative time difference between rendered image frames. For example, the timing information may include time stamps each associated with the completion of the rendering of a corresponding image frame. In other embodiments, the timing information indicates the time period between two identified image frames. In general, the timing information allows for the image frames that are rendered to be displayed as if they were delivered from the GPU in real time.

In one embodiment, computing system 500 includes a video encoder/decoder 550 that encodes the rendered image files as well as the timing information that are captured into a compressed format, which can be stored as a video file. The encoded video stream/file may be immediately streamed to a local or remote display, or stored for later delivery to a local or remote display. For example, the encoded video stream/file may be encoded using an H.264 or MPEG standards, or one of its derivatives, etc.

Figure 6:
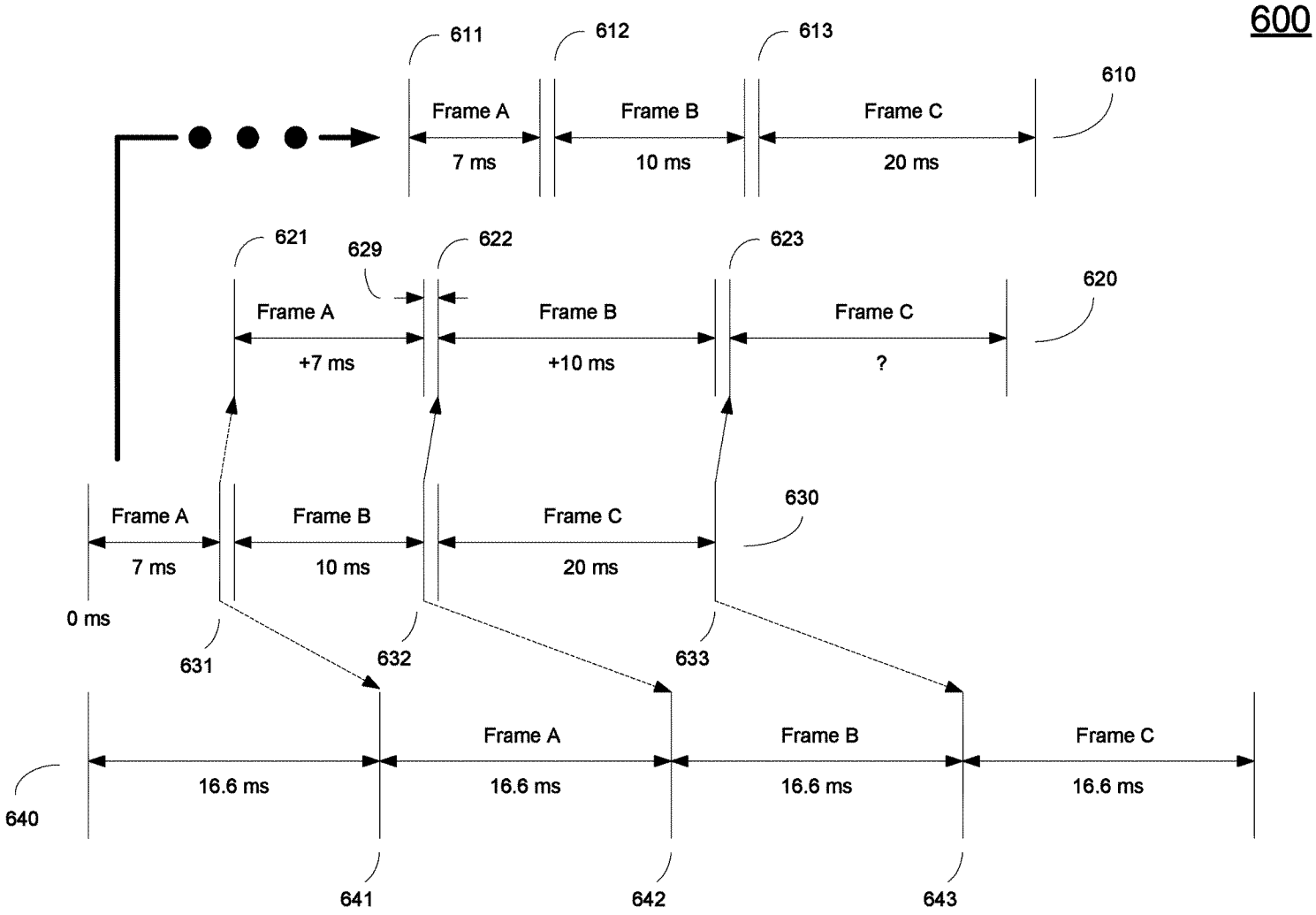
FIG. 6 is a timing diagram illustrating the display of rendering image frames using a display with vsync-on to display image frames directly from a GPU, with a display configured for dynamic display refresh to display image frames directly from a GPU, and a display configured to display image frames captured in a video file using render timing information such that the image frames are displayed as if rendered from a GPU in real-time, in accordance with one embodiment of the present disclosure.

FIG. 6 shows timing diagrams illustrating the display of rendering image frames using a display with vsync-on to display image frames directly from a GPU, with a display configured for dynamic display refresh to display image frames directly from a GPU, and a display configured to display image frames captured in a video file using render timing information such that the image frames are displayed as if rendered from a GPU in real-time, in accordance with one embodiment of the present disclosure.

As shown in FIG. 6, three image frames of a rendered video stream in timing diagram 630 are rendered by a corresponding GPU. The three frames are representative of a plurality of image frames associated with an application. To illustrate how timing information related to rendering is captured and encoded, the timing diagram 630 showing the rendering of image frames assumes that as soon as an image frame is rendered, that image frame can be stored into a corresponding buffer. In timing diagram 630, the GPU renders the image frames with varying render rates, as follows: the GPU takes about 7 ms (milliseconds) to render image frame A, 10 ms to render image frame B, and about 20 ms to render image frame C.

In a typical display device that is not capable of having a dynamic refresh rate, the display device may be running at 60 Hz, which corresponds to a 16.6 ms period for every refresh cycle, as is shown in timing diagram 640. If the display device is running in a vsync-on mode, then a rendered image frame must wait until the beginning of the next refresh cycle (e.g., as triggered by a VBLANK interval) before it can be displayed. While this allows each image frame that is rendered to be displayed fully, latency is introduced, such that rendered frames must wait before being displayed. For example, even though image frame A has been completely rendered by the GPU at point 631 in timing diagram 630, frame A is not displayed until the beginning of the next refresh cycle at point 641 of the display device of timing diagram 640. Similarly, image frame B has finished rendering at point 632 in diagram 630, which also occurs just after the start of refresh cycle (shown at point 641), but is not displayed until the beginning of the next refresh cycle at point 642. Also, image frame C has finished rendering at point 633, and is displayed at the beginning of the next refresh cycle at point 643.

Timing diagram 620 shows a display device that is capable of dynamically adjusting its refresh cycle to match the GPU render rate. That is, as soon as an image frame has been rendered by the GPU, it is delivered to the display device for displaying. In this case, the image frames are received from the GPU in real-time at the display device. For example, image frame A has been completely rendered by the GPU at point 631 in timing diagram 630, and is almost immediately (accounting for delivery and processing shown by the gaps between frames, such as gap 629) displayed at point 621 of daily device of timing diagram 620. Frame A is displayed for greater than 7 ms because the render rate of Frame B is longer than 7 ms. When Frame B is completely rendered by the GPU at point 632 in diagram 630, it is almost immediately displayed at the display device at point 622 of diagram 620. Frame A may be shown for a period that coincides with the render rate of the next image frame, such as Frame B, and as such may be greater than, equal to, or less than 7 ms. Also, when Frame C is completely rendered by the GPU at point 633 in diagram 630, it is almost immediately displayed at the display device at point 623 of diagram 620.

In embodiments of the present invention, timing information related to the rendering rate of each image frame in a video stream is captured and encoded. As a result, the image frames can be played or replayed using the timing information such that the displayed video is true to the rendering rate for each image frame, but displaced in time. Timing diagram 610 shows that the encoded video stream, including encoded image Frames A-C and the timing information, is stored, and played or replayed at a later time on the display device. As shown, the displayed video is true to the render rate of each image frame, such that each image frame is displayed for a period that is approximately equal to its render rate. That is, the refresh rate of the display device when displaying a particular image frame (e.g., Frame B) is approximately equal to the render rate of that image frame (Frame B). This is in contrast to timing diagram 630, wherein the refresh rate of an image frame (e.g., Frame B) that is displayed is tied to the render rate of the next image frame (e.g., Frame C). For example, timing diagram 610 shows the replayed video stream, wherein Frame A is displayed for approximately 7 ms, such that the refresh rate and render rate for Frame A is approximately 7 ms. Also, Frame B is displayed for approximately 10 ms, wherein the refresh rate and the render rate for Frame B is approximately 10 ms. Further, Frame C is displayed for approximately 20 ms, wherein the refresh rate and the render rate for Frame C is approximately 20 ms.

FIG. 7 is a flow diagram illustrating a method for capturing render timing information related to relative timing between rendering of a plurality of rendered image frames, in accordance with one embodiment of the present disclosure. In still another embodiment, flow diagram 700 illustrates a computer implemented method for capturing render timing information related to relative timing between rendering of a plurality of rendered image frames. In another embodiment, flow diagram 700 is implemented within a computer system including a processor and memory coupled to the processor and having stored therein instructions that, if executed by the computer system causes the system to execute a method for capturing render timing information related to relative timing between rendering of a plurality of rendered image frames. In still another embodiment, instructions for performing a method as outlined in flow diagram 700 are stored on a non-transitory computer-readable storage medium having computer-executable instructions for causing a computer system to perform a method for capturing render timing information related to relative timing between rendering of a plurality of rendered image frames. In embodiments, the method outlined in flow diagram 700 is implementable by one or more components of the systems 100, 400, and 500 of FIGS. 1, 4, and 5, respectively.

At 710, the method includes executing an application at a processor. The processor may be local with a display device, or may be remote from the display device. For example, the application may be executed by a virtual machine that is implemented through a cloud based graphics processing system, such as the architecture 400 of FIG. 4 that is configured to provide a plurality of virtual machines to a plurality of end users, wherein each of the virtual machines are fully operational computing system functioning under an operating system, such as, the Windows® operating system. In one particular implementation, the cloud based graphics processing system is a gaming platform where end users enter to play gaming applications that are stored and instantiated within the gaming platform, through a corresponding virtual machine.

In particular, the processor is configured to generate image frames sequentially through execution of the application. For example, the processor may run a long sequence of operations to produce a single, desired image frame. In addition, the processor utilizes the processing power of a plurality of GPUs to perform computational intensive operations, such as when rendering the image frames to a particular format for display.

At 720, the method includes rendering a plurality of image frames at the GPUs, as instructed by the processor when executing the application. For example, rendering of an image frame may include processing the image frame from a first format output by the processor to a second format used for transmitting the image frame to the display device. For example, the rendering may be performed on an image frame generated by the application to have various characteristics, such as objects, one or more light sources, a particular camera viewpoint, etc. The rendering may generate the image frame in a 3D format with each pixel colored in accordance with the characteristics defined for the image frame by the application.

At 730, the method includes determining information related to relative timing between renderings of the plurality of image frames. That is, the rendering rate for each frame is determined and reflected in the information. For purposes of illustration, a time stamp may be associated with the completion of rendering for a corresponding image frame. In another example, the relative time period between the completion of rendering of two image frames is determined and recorded. In still another example, the render rate for each frame may be determined and recorded. For instance, the timing information may be included as metadata along with the corresponding image frame that is rendered and encoded.

In one embodiment, the rendered images are captured and stored in a buffer. For example, the capturing may be performed in parallel with any process implemented to deliver the rendered image frames to a display device. In this manner, the image frames may be captured for later play or replay, even though the image frames are currently being delivered for display in real-time.

At 740, the method includes encoding the plurality of image frames that is rendered into a video file. For example, in one embodiment, the encoding is performed on the rendered image frames directly. In another example, the encoding is performed on the captured image frames. In addition, the timing information is also encoded into the video file at 750. For example, the encoding may be performed in compliance with the H.264 standard, or one of its derivatives. In another example, the encoding may be performed in compliance with the MPEG standard (e.g., MPEG-4), or one of its derivatives. In this manner, the encoded video file may be stored, and retrieved for later play or replay of the image frames.

In one embodiment, the method includes delivering the plurality of encoded image frames to a display device over a communication channel. The display device is configured to show the plurality of image frames in sequential order from the video file with the relative timing between image frames. For example, in one embodiment, an image frame is displayed with a refresh rate that is approximately equal to the render rate of the GPU associated with rendering that image frame.

In one embodiment, because the video file is stored and includes the encoded image frames along with the corresponding timing information related to the relative timing between renderings of the plurality of image frames, the video file may be played or replayed at a local display device, or at a remote display device. That is, the processor and the plurality of GPUs may be both local devices, or the processor and the plurality of GPUs may be located remotely from the display device.

When displaying the image frames, the rendering timing remains true because the display device is configured to adjust its refresh rate (e.g., by manipulating the VBLANK interval) to match a corresponding GPU render rate. In embodiments of the present invention, the refresh rate of an image frame that is displayed matches the render rate of a GPU that is rendering that image frame. In that manner, the displayed video is true to the rendering rate for each image frame, but displaced in time, such that the image frames are not immediately displayed after rendering, but stored and played at a later time.

In one embodiment, the encoding of the image frames and the timing information is performed in parallel with the sending of the image frames to a display device over a first communication channel. That is, the image frames may be delivered directly from the GPU as they are rendered, or the image frames may be delivered from the GPU as they are encoded. In addition, the timing information may be delivered along with the encoded image frames over the same, first communication channel, in one embodiment. In another embodiment, the timing information is delivered over a second communication channel. In both cases, the display devices is configured to the show or display the plurality of image frames using the timing information, such that the image frames are displayed as rendered, such as in a manner this remains true to their render rate, as previously described.

FIG. 8 is a flow diagram 800 illustrating a method for displaying image frames captured in a video file using render timing information such that the image frames are displayed as if rendered from a GPU in real-time, in accordance with one embodiment of the present disclosure.

In still another embodiment, flow diagram 800 illustrates a computer implemented method for displaying image frames captured in a video file using render timing information such that the image frames are displayed as if rendered from a GPU in real-time. In another embodiment, flow diagram 800 is implemented within a computer system including a processor and memory coupled to the processor and having stored therein instructions that, if executed by the computer system causes the system to execute a method for displaying image frames captured in a video file using render timing information such that the image frames are displayed as if rendered from a GPU in real-time. In still another embodiment, instructions for performing a method as outlined in flow diagram 800 are stored on a non-transitory computer-readable storage medium having computer-executable instructions for causing a computer system to perform a method for displaying image frames captured in a video file using render timing information such that the image frames are displayed as if rendered from a GPU in real-time. In embodiments, the method outlined in flow diagram 800 is implementable by one or more components of the systems 100, 400, and 500 of FIGS. 1, 4, and 5, respectively At 810, the method includes executing an application at a processor. The processor may be local with a display device, or may be remote from the display device. For example, the application may be executed by a virtual machine that is implemented through a cloud based graphics processing system, such as the architecture 400 of FIG. 4 that is configured to provide a plurality of virtual machines to a plurality of end users, wherein each of the virtual machines are fully operational computing system functioning under an operating system, such as, the Windows® operating system. In one particular implementation, the cloud based graphics processing system is a gaming platform where end users enter to play gaming applications that are stored and instantiated within the gaming platform, through a corresponding virtual machine. In particular, the processor is configured to generate image frames sequentially through execution of the application. For example, the processor may run a long sequence of operations to produce a single, desired image frame. In addition, the processor utilizes the processing power of a plurality of GPUs to perform computational intensive operations, such as when rendering the image frames to a particular format for display.

At 820, the method includes rendering a first image frame at the plurality of GPUs, as instructed by the processor when executing the application. For example, rendering of the first image frame may include processing the image frame from a first format output by the processor to a second format used for transmitting the image frame to the display device. For example, rendering of the first image frame may include processing the image frame from a first format output by the processor to a second format used for transmitting the image frame to the display device. The rendering may be performed on an image frame generated by the application to have various characteristics, such as objects, one or more light sources, a particular camera viewpoint, etc. The rendering may generate the first image frame in a 3D format with each pixel colored in accordance with the characteristics defined for the image frame by the application.

At 830, the method includes rendering a second image frame at the plurality of GPUs, as instructed by the processor when executing the application. As previously described in relation to the rendering of the first image frame in operation 820, the rendering of the second image frame may including processing the second image frame from first format output by the processor to a second format used for transmitting the image frame to the display device.

At 840, the method includes determining information related to a relative timing between renderings of said first image frame and said second image frame. That is, the rendering rate for the first and second image frames is determined and reflected in the information. For purposes of illustration, a time stamp may be associated with the completion of rendering for a corresponding image frame. In another example, the relative time period between the completion of rendering of two image frames is determined and recorded. In still another example, the render rate for each frame may be determined and recorded. For instance, the timing information may be included as metadata along with the corresponding image frame that is rendered and encoded.

For example, the timing information may include a first time stamp indicating a first time when the first video frame was rendered, and a second time stamp indicating a second time when the second video frame was rendered.

In one embodiment, the rendered first and second image frames are captured and stored in a buffer. For example, the capturing may be performed in parallel with any process implemented to deliver the rendered image frames to a display device. In this manner, the first and second image frames may be captured for later play or replay, even though the image frames are currently being delivered for display in real-time.

At 850, the method includes encoding the first and second image frames that are rendered, and the timing information. For example, in one embodiment, the encoding is performed on the rendered first and second image frames directly. In another example, the encoding is performed on the captured first and second image frames. In addition, the timing information is also encoded into a video file at 850. For example, the first time stamp and the second time stamp may be encoded. The encoding may be performed in compliance with the H.264 standard, or one of its derivatives. In another example, the encoding may be performed in compliance with the MPEG standard (e.g., MPEG-4), or one of its derivatives. In this manner, the encoded video file may be stored, and retrieved for later play or replay of the first and second image frames.

In one embodiment, at 860 the method includes delivering the first and second image frames to a display device over a communication channel. The display device is configured to show the first and second image frames in sequential order with the relative timing between image frames. For example, in one embodiment, the first image frame is displayed with a refresh rate that is approximately equal to the render rate of the GPU associated with rendering the first image frame. Similarly, the second image frame is displayed with a refresh rate that is approximately equal to the render rate of the GPU associated with rendering the second image frame.

In one embodiment, because the video file is stored and includes the encoded first and second image frames along with the corresponding timing information related to the relative timing between renderings of the plurality of image frames, the video file may be played or replayed at a local display device, or at a remote display device. That is, the processor and the plurality of GPUs may be both local devices, or the processor and the plurality of GPUs may be located remotely from the display device.

When displaying the image frames, the rendering timing remains true because the display device is configured to adjust its refresh rate (e.g., by manipulating the VBLANK interval) to match a corresponding GPU render rate. In embodiments of the present invention, the refresh rate of an image frame that is displayed matches the render rate of a GPU that is rendering that image frame. In that manner, the displayed video is true to the rendering rate for each of the first and second image frames, but displaced in time, such that the image frames are not immediately displayed after rendering, but stored and played at a later time.

Thus, according to embodiments of the present disclosure, systems and methods are described for displaying video by capturing render timing information related to relative timing between rendering of a plurality of rendered image frames, wherein video is displayed on a display device as it would be if rendered by a GPU in real-time.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered as examples in that many architectural variants can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

While various embodiments have been described and/or illustrated herein in the context of fully functional computing systems, one or more of these example embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. These software modules may configure a computing system to perform one or more of the example embodiments disclosed herein. One or more of the software modules disclosed herein may be implemented in a cloud computing environment. Cloud computing environments may provide various services and applications via the Internet. These cloud-based services (e.g., software as a service, platform as a service, infrastructure as a service, etc.) may be accessible through a Web browser or other remote interface. Various functions described herein may be provided through a remote desktop environment or any other cloud-based computing environment.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as may be suited to the particular use contemplated.

Embodiments according to the present disclosure are thus described. While the present disclosure has been described in particular embodiments, it should be appreciated that the disclosure should not be construed as limited by such embodiments, but rather construed according to the below claims.

What is claimed:

1. A method of displaying video on a display device, the method comprising:

accessing timing information related to processor rendering rates for a plurality of frames of said video;

accessing said plurality of frames; and displaying said plurality of frames on said display device in varying refresh frame rates based on said timing information, wherein a refresh frame rate for a respective frame of said plurality of frames coincides with a processor rendering rate for said respective frame.

2. The method of claim 1, wherein said processor rendering rate corresponds to a time between a graphics processing unit (GPU) processing said respective frame and said GPU processing a next frame.

3. The method of claim 2, wherein said timing information comprises time stamps of said GPU rendering said plurality of frames.

4. The method of claim 2, wherein said timing information is in a form of metadata associated with said plurality of frames.

5. The method of claim 2, wherein said graphics processing unit (GPU) processing said respective frame comprises processing said respective frame from a first format output by a central processing unit (CPU) to a second format used for transmitting said respective frame to said display device.

6. The method of claim 1, wherein said accessings comprise receiving said timing information and said plurality of frames through different communication channels.

7. The method of claim 1, wherein said timing information and said plurality of frames are contained in a video file in an encoded form.

8. A system comprising:

a main processor;

a display device coupled to the main processor;

a frame buffer coupled to said display device; and a non-transitory computer-readable medium having computer-executable instructions for causing said system to perform a method comprising:

accessing timing information related to processor rendering rates for a plurality of frames of a video;

accessing said plurality of frames from said frame buffer; and causing said display device to display said plurality of frames in varying refresh frame rates based on said timing information, wherein a refresh frame rate for a respective frame of said plurality of frames matches a processor rendering rate for said respective frame.

9. The system of claim 8, wherein said processor rendering rate corresponds to a time between a graphics processing unit (GPU) processing said respective frame and said GPU processing a next frame.

10. The system of claim 9, wherein said timing information comprises time stamps of said GPU rendering said plurality of frames.

11. The system of claim 10 further comprising a communication circuit operable to be coupled to a communication network, wherein said GPU is resident on a remote computing system coupled to said communication network.

12. The system of claim 11, wherein said system is configured to receive said timing information and said plurality of frames through different communication channels in said communication network.

13. The system of claim 11, wherein said timing information and said plurality of frames are transmitted from said remote computing system in an encoded video file.

14. The system of claim 9, wherein said GPU processing said respective frame comprises processing said respective frame from a first format output by a central processing unit (CPU) to a second format used for transmitting said respective frame to said display device.

15. The system of claim 8, wherein said timing information is in a form of metadata associated with said plurality of frames.

16. A method rendering a video for display, said method comprising:

rendering a plurality of frames of said video by a processor in varying rendering rates;

recording timing information related to said varying rendering rates;

encoding said timing information;

encoding said plurality of frames; and sending said timing information and said plurality of frames for display on a display device, wherein said timing information is operable to cause a display device to display said plurality of frames in varying refresh frame rates, wherein a refresh frame rate on said display device for a respective frame of said plurality of frames corresponds to a rendering rate for said respective frame by said processor.

17. The method of claim 16, wherein said timing information is in a form of metadata associated with said plurality of frames.

18. The method of claim 16, wherein said sending comprises sending said timing information and said plurality of frames in different communication channels in a communication network.

19. The method of claim 17, wherein said rendering rate corresponds to a time between said processor processing said respective frame and said processor processing a next frame of said plurality of frames.

20. The method of claim 19, wherein said recording comprises recording a time stamp of said processor processing each of said plurality of frames.

* * * * *